United States Patent [19]

Collingborn

[11] Patent Number: 5,044,345

[45] Date of Patent: Sep. 3, 1991

[54] FUEL PUMPING APPARATUS

[75] Inventor: Peter A. G. Collingborn, Gilligham, England

[73] Assignee: Lucas Industries public limited company, West Midlands, England

[21] Appl. No.: 597,040

[22] Filed: Oct. 15, 1990

[30] Foreign Application Priority Data

Oct. 18, 1989 [GB] United Kingdom ..... 8923485

[51] Int. Cl.[5] ..... F02M 41/06

[52] U.S. Cl. ..... 123/506; 123/447; 123/450

[58] Field of Search ..... 123/447, 450, 506, 179 L, 123/449; 417/462

[56] References Cited

U.S. PATENT DOCUMENTS

| | | | |
|---|---|---|---|
| 2,810,376 | 10/1957 | Aldinger | 123/506 |
| 4,401,084 | 8/1983 | Jarrett et al. | 123/450 |
| 4,530,337 | 7/1985 | Laufer | 123/506 |
| 4,696,271 | 9/1987 | Lebianc | 123/450 |
| 4,896,645 | 1/1990 | Potter | 123/450 |
| 4,969,442 | 11/1990 | Taue et al. | 123/447 |

FOREIGN PATENT DOCUMENTS

| | | | |
|---|---|---|---|
| 0343759 | 11/1989 | European Pat. Off. | 123/450 |
| 2054754 | 7/1979 | United Kingdom | 123/450 |
| 2142388 | 1/1985 | United Kingdom | 123/447 |

*Primary Examiner*—Carl Stuart Miller
*Assistant Examiner*—Thomas N. Moulis
*Attorney, Agent, or Firm*—Staas & Halsey

[57] ABSTRACT

A distributor type fuel injection pump has a main pumping plunger and an auxiliary plunger operable in synchronism by a cam. Also provided is a fluid pressure operable spill valve which is opened when the pressure of fluid developed by the auxiliary plunger becomes sufficiently high. The fluid displaced by the auxiliary plunger causes movement of a shuttle and the movement of the shuttle is halted to cause operation of the spill valve, by an hydraulic lock which is created when the movement of the shuttle closes an escape path from the end of the cylinder in which it is located.

9 Claims, 1 Drawing Sheet

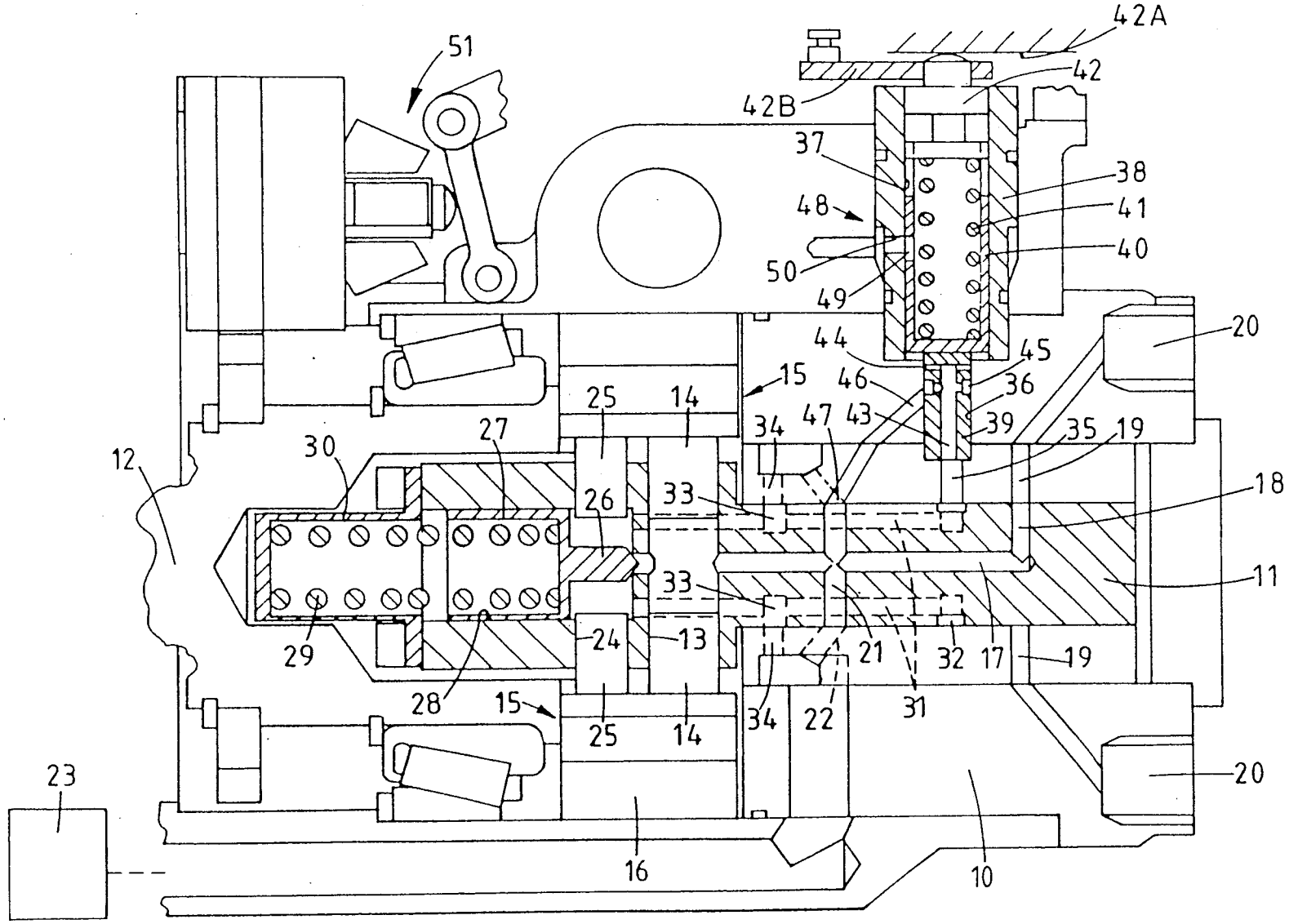
42A
42
38
41
40
20
18
11
20
35
19
19
45
36
39
17
10
32
31
37
48
49
44
46
43
21
47
22
42B
50
15
34
34
33
33
13
14
14
16
25
26
24
25
15
27
28
51
30
29
12
23

FUEL PUMPING APPARATUS

This invention relates to a fuel pumping apparatus for supplying fuel to an internal combustion engine and of the kind comprising a rotary distributor member, a pumping plunger mounted in a bore in the distributor member, a cam for imparting inward movement to the plunger as the distributor member rotates, passage means through which fuel displaced from the bore during successive inward movements of the pumping plunger can flow to a plurality of outlet ports in turn, fluid pressure operable valve means for spilling fuel from said bore to terminate the flow of fuel through an outlet port, auxiliary plunger means operable in synchronism with said pumping plunger, a shuttle slidable in a cylinder and means urging the shuttle to one end of said cylinder, the shuttle being moved away from said one end of the cylinder by fuel displaced by said auxiliary plunger means, to a position at which the pressure of fluid applied to said valve means is sufficient to open said valve means to spill fuel.

It is known to provide a mechanical stop to determine said position of the shuttle, the stop being adjustable to allow the quantity of fuel supplied by the apparatus to the associated engine to be varied. The position of the stop is determined by a governor mechanism and with such an arrangement it is necessary to ensure that the impact of the shuttle with the stop does not result in the application of impact loads to the governor mechanism otherwise the fuel setting as determined by the governor mechanism, may be disturbed.

The object of the invention is to provide an apparatus of the kind specified in a simple and convenient form.

According to the invention said position of the shuttle is determined by an hydraulic lock created in the other end of the cylinder containing the shuttle, the shuttle being movable angularly in the cylinder to determine the position at which said hydraulic lock is created.

An example of an apparatus in accordance with the invention will now be described with reference to the accompanying drawing which is a diagrammatic sectional side elevation of the apparatus.

Referring to the drawing the apparatus comprises a multi-part body 10 in which is mounted a rotary cylindrical distributor member 11 which is coupled to a drive shaft 12 adapted in use to be driven in timed relationship with the associated engine.

Formed in the distributor member is a transverse bore 13 in which is mounted a pair of pumping plungers 14. At their outer ends the plungers are engaged by cam followers 15 respectively each of which comprises a shoe which is slidably mounted in a radial slot in an enlarged portion of the drive shaft, and a roller carried by the shoe and engageable with the internal peripheral surface of an annular cam ring 16. On the internal peripheral surface of the cam ring are a plurality of pairs of diametrically disposed cam lobes the leading flanks of which during rotation of the distributor member, impart inward movement to the cam followers and the pumping plungers 14.

The bore 13 communicates with a longitudinal passage 17 formed in the distributor member and which communicates with an outwardly extending delivery passage 18 which is positioned to register in turn with a plurality of outlet ports 19 formed in the body part and connected respectively to outlets 20 which in use are connected to the injection nozzles of the associated engine. The delivery passage 18 registers with an outlet port 19 during the whole time the plungers are moved inwardly by the cam lobes.

At another position the passage 17 communicates with a plurality of outwardly extending inlet passages 21 which can register with inlet ports 22 formed in the body and which communicate with the outlet of a low pressure pump which is diagrammatically illustrated at 23. The output pressure of the low pressure pump is controlled so that it varies in known manner, with the speed at which the apparatus is driven.

Also formed in the distributor member is a further transverse bore 24 in which is mounted a pair of auxiliary pumping plungers 25. The plungers 25 are engaged by the cam followers 15 respectively so that the pumping plungers 14 and the auxiliary plungers 25 move inwardly at the same time under the action of the cam lobes. A short portion of the passage 17 extends between the bores 13 and 24 and at its opening into the bore 24 there is formed a seating with which can cooperate a valve member 26 which traverses the bore 24 and is connected to a piston 27 slidable within a cylinder 28 formed in the distributor member. The piston is of cup-shaped form and locates one end of a coiled compression spring 29 the other end of which is located by a cap 30 which is secured to the distributor member.

The bore 24 communicates with one or as shown, a plurality of axially extending passages 31 formed in the distributor member and which are connected to a circumferential groove 32 formed on the periphery of the distributor member. In addition, the passages 31 are connected to radially disposed filling passages 33 respectively which can communicate as will be explained, with filling ports 34 which are connected to the outlet of the low pressure pump 23.

The circumferential groove 32 is in constant communication with a radially disposed port 35 which is formed in the body and which opens into one end of a first cylinder 36 formed in the body. A second cylinder 37 coaxial with the first cylinder is defined in an insert 38 which is secured within the body and slidable within the first cylinder is a valve element in the form of a cylindrical valve member 39. Slidable within the second cylinder is a cup-shaped shuttle 40 which is urged towards one end of the second cylinder by means of in the example, a coiled compression spring 41 one end of which engages with the shuttle and the other end of which engages an angularly adjustable plug 42 secured within the other end of the second cylinder. The plug 42 is coupled to the shuttle and its axial position is fixed. Its angular position is determined by a governor mechanism 51 as will be explained.

The length of the valve member 39 is slightly longer than the length of the cylinder 36 in which it is located and the shuttle bears against the end of the valve member under the action of the spring 41. Formed in the valve member is a blind axial passage 43 which is in constant communication with the port 35. Adjacent the end of the valve member engaged by the shuttle is a transverse drilling 44 which communicates with the passage 43 and the passage 43 also communicates with a circumferential groove 45 formed on the periphery of the valve member intermediate the ends thereof. Opening into the first cylinder 36 is a port 46 which communicates with a further port 47 opening onto the periphery of the distributor member at a position to register in turn with the inlet passages 21. The groove 45 and the port 46 are positioned so that they communicate with each other when the shuttle 40 and the valve member 39 have been moved their maximum extent by the spring 41.

The plug 42 forms a fuel tight fit within the cylinder 37 and formed in the wall of the shuttle and in the wall of the cylinder is cooperating port and helical slot means generally indicated at 48. In the example the shuttle is provided with a helical slot 49 in its wall and the insert 38 is provided with a port 50 which is in communication with the outlet of the low pressure pump 23.

As shown in the drawing the parts of the apparatus are in a position immediately prior to inward movement of the plungers 14 and 25 by the cam means. It will be noted that the delivery passage 18 is in communication with an outlet port 19 and an inlet passage 21 is in register with the further port 47. As both the pumping plungers 14 and the auxiliary plungers 25 are moved inwardly, fuel under pressure generated by such inward movement will be applied to the cylindrical valve member 39. Any voids in the fuel contained in the bore 24, the passages 31 and the drillings in the valve member will be collapsed and no fuel will be supplied to the associated engine until sufficient movement of the valve member 39 has taken place against the action of the spring 41 to move the groove 45 out of register with the port 46. When such movement has occurred fuel will be displaced to an outlet port 20 and supplied to the associated engine. In addition, the valve member 39 will move against the action of the spring 41 at the same time moving the shuttle, and fuel will flow from the other end of the second cylinder 37 by way of the slot 49 and the port 50. When sufficient movement of the valve member has taken place to expose the transverse drilling 44 to the inner end of the second cylinder, fuel will flow from the drilling 44 into the cylinder and act upon the shuttle. It is to be expected however that the valve member will continue to follow the movement of the shuttle under the action of fuel displaced by the plungers 25 and this movement continues until the slot 49 moves out of register with the port 50 at which time an hydraulic lock is created in the second cylinder to prevent further movement of the shuttle. The initial movement of the valve member 39 is rapid due to its small diameter in order to minimise the lost pumping stroke of the plungers. When the fuel displaced by the auxiliary plungers 25 acts on the full area of the shuttle the rate of movement is reduced because of the increased area of the shuttle and because of the fact that fuel displaced by the main plungers 14 is now flowing to an outlet.

When the movement of the shuttle is prevented a pressure is built up in the bore 24 and this pressure acting upon the piston 27 together with the pressure in the bore 13 which acts upon the area of the valve member 26 within the seating, will be sufficient to move the piston 27 and the valve member against the action of the spring 29. The valve member 26 is therefore lifted from the seating and the high pressure of fuel in the bore 13 is lowered to the extent that delivery of fuel to the associated engine ceases. Inward movement of the plungers 14 and 25 continues to take place but the fuel displaced by such movement is absorbed by movement of the piston 27 against the action of its spring.

As the distributor member continues to rotate the cam followers will ride over the crests of the cam lobes and the delivery passage 18 and the inlet passage 21 will move out of register with an outlet port 19 and the further port 47 respectively. The inlet passages 21 will move into register with the inlet ports 22. In addition, the filling passages 33 will move into register with the filling ports 34 and fuel will flow into the bores 13 and 24 to effect outward movement of the plungers. The fuel stored by the piston 27 will be returned to the bores 13 and 24 by the action of the spring 29 and the spring 41 will move the shuttle and the valve member to the initial position shown in the drawing. The return movement of the shuttle and the valve member is assisted by fuel from the low pressure pump 23 which can flow through the port 50.

The amount of fuel which is delivered to the associated engine depends upon the position at which the hydraulic lock is created and this is adjustable by effecting angular movement of the shuttle 40 by means of the plug 42. The plug 42 in practice will be connected to a governor mechanism which may be of the electronic type or it may be a mechanical governor generally indicated at 51. As shown the plug 42 is engaged with a reaction surface 42A to prevent axial movement and the plug is provided with an arm 42B coupled to the governor mechanism 51, the latter having an operator adjustable member for varying the force extended by a governor spring not shown.

By utilizing an hydraulic lock to halt the movement of the shuttle the application of mechanical forces to the governor mechanism is avoided. Moreover, as the port 50 and slot 49 move out of register, the pressure within the end of the cylinder containing the spring gradually increases as also does the pressure applied to the piston 27. Since the flow rate of the fuel supplied to the one end of the cylinder increases as the speed of the engine increases, the pressure applied to the piston will also increase in a manner which depends upon the engine speed. It is possible by shaping the port 50 and the slot 49, to arrange for the valve member to be lifted from its seating before closure of the port 50 occurs and in this manner what is known in the art as "torque control" can be obtained.

I claim:

1. A fuel pumping apparatus for supplying fuel to an internal combustion engine comprising a rotary distributor member, a pumping plunger mounted in a bore in the distributor member, a cam for imparting inward movement to the plunger as the distributor member rotates, passage means through which fuel displaced from the bore during successive inward movements of the pumping plunger can flow to a plurality of outlet ports in turn, fluid pressure operable valve means for spilling fuel from said bore to terminate the flow of fuel through an outlet port, auxiliary plunger means operable in synchronism with said pumping plungers, a shuttle slidable in a cylinder, means urging the shuttle towards one end of said cylinder, the shuttle being moved away from said one end of the cylinder by fluid displaced by said auxiliary plunger means, to a position at which the pressure of fluid applied to said valve means is sufficient to open said valve means to spill fuel, said position of the shuttle being determined by an hydraulic lock created in the other end of the cylinder containing the shuttle, and means for adjusting the angular position of the shuttle in the cylinder to determine the position at which said hydraulic lock is created.

2. An apparatus according to claim 1 including cooperating port and helical slot means in the wall of the cylinder and the shuttle and through which fluid can escape from the other end of the cylinder.

3. An apparatus according to claim 2 in which said cooperating port and helical slot means when open, connects said other end of the cylinder with a source of fluid under pressure.

4. An apparatus according to claim 2 or claim 3 including by a spring biasing the shuttle towards the one end of the cylinder.

5. An apparatus according to claim 1 including a plug mounted in the other end of the cylinder and means coupling the plug and shuttle whereby angular movement of the plug will be transmitted to the shuttle.

6. An apparatus according to claim 5 in which the angular setting of the plug is determined by a governor mechanism.

7. An apparatus according to claim 1 in which said valve means includes a piston defining a surface exposed to the pressure of fluid generated during the inward movement of the auxiliary plunger and a spring acting on the piston to urge the valve means to the closed position.

8. An apparatus according to claim 1 including a valve member located in a further cylinder, said valve member being subject to the pressure of fluid generated during inward movement of said auxiliary plunger, said valve member engaging said shuttle and the fluid pressure acting on said valve member acting to initiate movement of the shuttle away from said one end of the cylinder, said valve member after a predetermined initial movement connecting said one end of the cylinder to receive directly fluid displaced by the auxiliary plunger.

9. An apparatus according to claim 8 in which said valve member when said shuttle is at said one end of the cylinder provides communication between the bores containing the pumping and auxiliary plungers, said communication being broken prior to the termination of said predetermined initial movement.

* * * * *